United States Patent [19]

Abel

[11] 4,288,226

[45] Sep. 8, 1981

[54] PROCESS FOR SLOP-PADDING TEXTILE CELLULOSE MATERIAL

[75] Inventor: Heinz Abel, Reinach, Switzerland

[73] Assignee: Ciba-Geigy Corporation, Ardsley, N.Y.

[21] Appl. No.: 77,421

[22] Filed: Sep. 20, 1979

[30] Foreign Application Priority Data

Nov. 8, 1978 [CH] Switzerland ..... 11481/78

[51] Int. Cl.[3] ..... D06P 1/38; D06P 1/56; D06P 3/60

[52] U.S. Cl. ..... 8/496; 8/904; 8/532; 8/533; 8/534; 260/29.4 R

[58] Field of Search ..... 8/2.5 A, 17, 18, 54.2, 8/471, 496, 470

[56] References Cited

U.S. PATENT DOCUMENTS

| | | | |
|---|---|---|---|
| 3,142,529 | 7/1964 | Freyermuth et al. | 8/18 |
| 3,411,860 | 11/1968 | Braun et al. | 8/18 |
| 3,458,271 | 7/1969 | Ito et al. | 8/18 |
| 3,468,618 | 9/1969 | Buehler et al. | 8/18 |
| 3,983,588 | 10/1976 | Buhler et al. | 8/17 |
| 4,009,000 | 2/1977 | Buhler | 8/17 |
| 4,056,354 | 11/1977 | Pittman et al. | 8/54.2 |
| 4,207,069 | 6/1980 | Ono | 8/471 |

FOREIGN PATENT DOCUMENTS

| | | | |
|---|---|---|---|
| 696369 | 10/1964 | Canada | 8/18 |
| 1232546 | 1/1967 | Fed. Rep. of Germany | 8/18 |
| 1271144 | 7/1961 | France | 8/18 |
| 1494083 | 7/1967 | France . | |
| 390217 | 7/1965 | Switzerland . | |
| 898958 | 6/1962 | United Kingdom | 8/18 |
| 953253 | 3/1964 | United Kingdom . | |
| 957231 | 5/1964 | United Kingdom . | |
| 976556 | 11/1964 | United Kingdom . | |
| 1138208 | 12/1968 | United Kingdom . | |

*Primary Examiner*—Joseph L. Schofer
*Assistant Examiner*—Maria Parrish Tungol
*Attorney, Agent, or Firm*—Edward McC. Roberts

[57] ABSTRACT

A novel process for the continuous dyeing of cellulose textile material with anionic substantive dyes is disclosed. The process consists initially in applying to the cellulose material an aqueous liquor which, in addition to the dye, contains (A) 2.5 to 15 g/l of an etherified N-methylolmelamine,
(B) an acid catalyst and at least one of the components
(C) an anionic surfactant,
(D) a non-ionic surfactant and
(E) an organic solvent which boils above 140° C.

The material is then dried, if desired, and subsequently subjected to a heat treatment. An increase in dye yield of 100 to 400% is obtained with this process in continuous dyeing, especially in a pad-thermofix process. The dyeings are level and have excellent wetfastness and lightfastness properties.

26 Claims, No Drawings

PROCESS FOR SLOP-PADDING TEXTILE CELLULOSE MATERIAL

The present invention relates to a novel continuous process for dyeing textile cellulose material with anionic substantive dyes, and to the cellulose material dyed by this process.

The process of the invention consists in applying to the cellulose material an aqueous liquor which, in addition to the dye, contains (A) 2.5 to 15 g/l of an etherified N-methylolmelamine, (B) an acid catalyst and at least one of the components (C) an anionic surfactant, (D) a non-ionic surfactant, and (E) an organic solvent which boils about 140° C., if desired drying said material, and subsequently subjecting it to a heat treatment.

In addition to containing the anionic substantive dye and components (A) and (B), the dye liquor of the present invention always additionally contains at least one of the components (C), (D) and (E), either singly or in admixture.

Preferred dye liquors contain the following components:

(A)+(B)+(C)
(A)+(B)+(C)+(E)
(A)+(B)+(D)
(A)+(B)+(E) or
(A)+(B)+(C)+(D).

Both completely as well as only partially etherified N-methylolamines are suitable for use as component (A). The N-methylolmelamines are preferably esterified with methanol or ethanol. Examples of suitable etherified N-methylolmelamines are trimethylolmelamine-trimethyl or -triethyl ether, pentamethylolmelamine-di-bis-trimethyl ether, hexamethylolmelamine-tetramethyl ether, hexamethylolmelamine-pentamethyl ether and, in particular, hexamethylolmelamine-hexamethyl or -hexaethyl ether. The etherified N-methylolmelamines to be used in the present invention are known compounds and can be obtained by known methods.

Component (A) is preferably added to the padding liquor in an amount varying from 2.5 to 15 g/l, preferably from 5 to 15 g/l.

As component (B), the aqueous padding liquor contains an acid catalyst. Particularly suitable acid catalysts are salts of weak bases and mineral acids, for example zinc chloride, zinc nitrate, magnesium nitrate, magnesium chloride, or mineral acid salts of organic amines, such as mono-, di- or triethanolamine hydrochloride, or 2-amino-2-methylpropanol hydrochloride and also weak acids, for example organic acids, such as oxalic acid. Preferred catalysts are ammonium salts of organic salts or lower ($C_1$–$C_5$) carboxylic acids, for example ammonium chloride, ammonium bromide, ammonium sulfate, ammonium acetate, ammonium hydrogen sulfate, diammonium sulfate, or ammonium salts of succinic acid, maleic acid, adipic acid, sulfamic acid, or also of ethylenediaminetetraacetic acid and, in particular, hydroxylamine sulfate.

The acid catalyst is added to the padding liquor preferably in an amount from 0.5 to 10 g/l, most preferably from 1 to 5 g/l.

The anionic surfactants of component (C) are preferably anionic alkylene oxide adducts, for example adducts containing acid ether groups or preferably acid ester groups of inorganic or organic acids, of alkylene oxides, in particular ethylene oxide and/or propylene oxide or also styrene oxide, with organic hydroxyl, carboxyl, amino and/or amido compounds or mixtures thereof containing aliphatic hydrocarbon radicals having a total of at least 8 carbon atoms. These acid ethers or esters can be in the form of free acids or salts, e.g. alkali metal, alkaline earth metal, ammonium or amine salts.

These anionic surfactants are obtained by known methods by addition of at least 1 mole, preferably more than 1 mole, e.g. 2 to 60 moles, of ethylene oxide or propylene oxide, or alternately, in any order, ethylene oxide and propylene oxide, to the above organic compounds, and subsequently etherifying or esterifying the adducts and, if desired, converting the ethers or esters into their salts. Suitable starting materials are higher fatty alcohols, i.e. alkanols or alkenols containing 8 to 22 carbon atoms, polyhydric alkanols containing 2 to 6 carbon atoms, alicyclic alcohols, phenylphenols, alkylphenols containing one or more alkyl substituents which together contain at least 8 carbon atoms, fatty acids containing 8 to 22 carbon atoms; amines which contain aliphatic and/or cycloaliphatic hydrocarbon radicals having at least 8 carbon atoms, in particular fatty amines, hydroxyalkylamines, hydroxyalkylamides and aminoalkyl esters of fatty acids or dicarboxylic acids and of higher alkylated aryloxycarboxylic acids, all of which contain such radicals.

Component (C) can be e.g. a compound of the formula $$Q-\left[(\underset{Y_1}{\underset{|}{CH}}-\underset{Y_2}{\underset{|}{CH}}-O)_m-X\right]_q \qquad (1)$$

wherein Q is $R_1$—O—, $R_2(O\rightarrow)_t$, $R_3$—CO—O— or $R_4$—N<, $R_1$ is a monovalent aliphatic hydrocarbon radical of 8 to 22 carbon atoms, a cycloaliphatic hydrocarbon radical of 10 to 22 carbon atoms, o-phenylphenyl or alkylphenyl containing 4 to 16 carbon atoms in the alkyl moiety, $R_2$ is a t-valent aliphatic hydrocarbon radical of 2 to 6 carbon atoms, $R_3$ is an aliphatic hydrocarbon radical of 7 to 21 carbon atoms, $R_4$ is an aliphatic hydrocarbon radical of 12 to 22, in particular 12 to 18, carbon atoms, one of $Y_1$ and $Y_2$ is hydrogen, methyl or phenyl and the other is hydrogen, X is the acid radical of an inorganic oxygen-containing acid or of a dicarboxylic acid or is the radical —$CH_2COOH$, m is 1 to 30, t is 2 to 6 and q is 1 or, if Q is $R_2(O)_t$, is 2 to 6, or, if Q is $R_4$—N<, q is 2, with the proviso that the substituents of $R_2$ or the two substituents at the nitrogen atom are the same or different.

Very suitable components (C) preferably have the formula $$R_1-O-(\underset{Y_1}{\underset{|}{CH}}-\underset{Y_2}{\underset{|}{CH}}-O)_m-X \qquad (2)$$

$$R_3-CO-O-(\underset{Y_1}{\underset{|}{CH}}-\underset{Y_2}{\underset{|}{CH}}-O)_m-X \text{ or} \qquad (3)$$

-continued

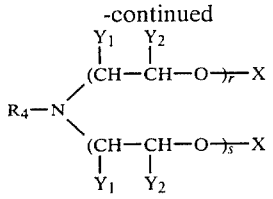

(4)

wherein $R_1$, $R_3$, $R_4$, $Y_1$, $Y_2$, X and m have the given meanings and r and s are integers, the sum of which is 2 to 15. Preferred surfactants are those of the formula (2).

The radical $R_1$—O— can be derived e.g. from alcohols containing preferably 8 to 24 carbon atoms, for example 2-ethylhexanol, decyl, lauryl, tridecyl, myristyl, cetyl, stearyl, oleyl, arachidyl and behenyl alcohol, as well as from hydroabietyl alcohol, the alfols, or from o-phenylphenol or alkylphenols, for example butylphenol, hexylphenol, n-octylphenol, n-nonylphenol, p-tert-octylphenol, p-tert-nonylphenol, decylphenol, dodecylphenol, tetradecylphenol or hexadecylphenol.

The alfols are linear primary alcohols. The number behind the names indicate the average number of carbon atoms which the alcohol contains. Some representatives of these alfols are:alfol (8–10), (10–14), (12), (16), (18), (20–22).

The radical $R_2(O)_r$ is preferably derived from a divalent to hexavalent, preferably trivalent to hexavalent, aliphatic alcohol. Such an alcohol contains preferably 2 to 6 carbon atoms and is, in particular, ethylene glycol, propylene glycol, pentanediol, glycerol, trimethylolpropane, erythritol, pentaerythritol, mannitol and sorbitol. Preferred alcohols are trivalent to hexavalent alcohols which are advantageously reacted with propylene oxide or propylene oxide and ethylene oxide.

The radical $R_3$—COO— is derived e.g. from fatty acids containing 8 to 22 carbon atoms, for example caprylic, lauric, capric, myristic, stearic, arachidic, behenic, coconut fatty, decenoic, linolic, linolenic, oleic, eicosenoic, docosenoic or clupanodonic acid.

$R_4$ is preferably an alkyl or alkenyl radical of 12 to 22, in particular 16 to 22, carbon atoms, $Y_1$ and $Y_2$ are preferably hydrogen. The sum of r+s is advantageously 6 to 8. Each of $Y_1$ and $Y_2$ can have different meanings in the same molecule.

$R_4$ as alkyl can be e.g. n-dodecyl, myristyl, n-hexadecyl, n-heptdecyl, n-octadecyl, arachidyl or behenyl. $R_4$ as alkenyl can be e.g. dodecenyl, hexadecenyl, oleyl or octadecenyl.

The aliphatic amines which are required as starting materials for obtaining the preferred adducts of the formula (4) can contain saturated or unsaturated, branched or unbranched hydrocarbon radicals. These hydrocarbon radicals preferably contain 16 to 22 carbon atoms.

The amines can be chemically homogeneous or in the form of mixtures. Mixtures of amines are preferably those which are formed during the conversion of natural fats or oils, e.g. tallow fats, soybean or coconut oil, into the corresponding amines. Specific examples of amines are octylamine, dodecylamine, hexadecylamine, heptadecylamine, octadecylamine, tallow fatty amine, behenylamine and octadecenylamine (oleylamine).

Adducts with the amines can be formed with ethylene oxide or, to introduce the methyl or phenyl group into the ethyleneoxy groups, also with propylene oxide and/or styrene oxide. Propylene oxide is preferably used in admixture with ethylene oxide. It is advantageous to use, per mole of amine, 5 to 15 moles of propylene oxide and at least 15 moles, preferably 20 to 35 moles, of ethylene oxide. The addition of styrene oxide is advantageously effected before the addition of ethylene oxide. In this case, it is preferred to use, per mole of amine, 1 mole of styrene oxide and 15 to 30 moles of ethylene oxide.

The acid radical X can be derived from an organic, preferably aliphatic dicarboxylic acid containing 2 to 6 carbon atoms, for example maleic acid, malonic acid, succinic acid or, in particular, sulfosuccinic acid, or it can be introduced by reaction with a haloacetic acid, for example chloroacetic acid. In particular, however, X is derived from an inorganic polyvalent oxyacid, for example orthophosphoric acid or sulfuric acid.

The acid radical X exists preferably in salt form, that is to say e.g. as alkali metal, alkaline earth metal, ammonium or amine salt. Examples of such salts are: sodium, potassium, calcium, ammonium, trimethylamine, ethanolamine, diethanolamine or triethanolamine salts. Sodium and ammonium salts are preferred.

The alkylene oxide units

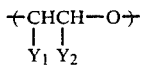

are as a rule ethylene oxide or 1,2-propylene oxide units. The latter are preferably in admixture with ethylene oxide units in the compounds of the formulae (2) to (4).

Preferred components (C) are compounds of the formula (2), wherein $R_1$ is alkylphenyl containing 4 to 12 carbon atoms in the alkyl moiety, o-phenylphenyl or alkyl or alkenyl, each containing 8 to 18 carbon atoms, and m is 2 to 15. A particularly suitable component (C) is an anionic surfactant of the formula

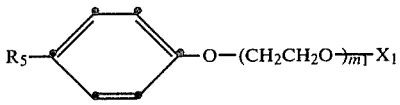

(5)

wherein $R_5$ is octyl or nonyl, $m_1$ is 2 to 10, $X_1$ is derived from sulfuric acid or orthophosphoric acid, and the surfactant is in the form of the free acid or the sodium or ammonium salt.

Particularly interesting anionic surfactants are also those of the formula (4), wherein $R_4$ is alkenyl or, most preferably, alkyl, each of 16 to 22 carbon atoms. $Y_1$ and $Y_2$ are hydrogen, the sum of r+s is 2 to 10, in particular 4 to 10, X is —$SO_3M$, and M is sodium or —$NH_4$.

Component (D) is advantageously a non-ionic alkylene oxide adduct of 1 to 100 moles alkylene oxide, e.g. ethylene oxide and/or propylene oxide, with 1 mole of an aliphatic monoalcohol containing at least 4 carbon atoms, of a trivalent to hexavalent aliphatic alcohol, of a phenol which is unsubstituted or substituted by alkyl or phenyl, or of a fatty acid containing 8 to 22 carbon atoms.

The aliphatic monoalcohols employed for obtaining component (D) are e.g. water-insoluble monoalcohols containing at least 4, preferably 8 to 22, carbon atoms. These alcohols can be saturated or unsaturated and branched or straight chain, and they can be employed by themselves or in mixtures with one another. It is possible to react natural alcohols, e.g. myristyl alcohol, cetyl alcohol, stearyl alcohol or oleyl alcohol, or synthetic alcohols, preferably 2-ethylhexanol, and also trimethylhexanol, trimethylnonyl alcohol, hexadecyl alcohol or the above alfols, with the alkylene oxide.

Further aliphatic alcohols which can be reacted with alkylene oxide are trivalent to hexavalent alkanols. These alkanols contain 3 to 6 carbon atoms and are in particular glycerol, trimethylolpropane, erythritol, mannitol, pentaerythritol and sorbitol. The trivalent to hexavalent alcohols are preferably reacted with propylene oxide or ethylene oxide or with mixtures of these alkylene oxides.

Examples of suitable unsubstituted or substituted phenols are: phenol, o-phenylphenol or alkylphenols containing 1 to 16, preferably 4 to 12 carbon atoms in the alkyl moiety. Examples of these alkylphenols are: p-cresol, butylphenol, tributylphenol, octylphenol and, in particular, nonylphenol.

The fatty acids preferably contain 8 to 22 carbon atoms and can be saturated or unsaturated. Example of these fatty acids are: capric, lauric, myristic, palmitic or stearic acid, and decenoic, dodecenoic, tetradecenoic, hexadecenoic, oleic, linolic, linolenic, or ricinoleic acid.

Preferred alkylene oxide reaction products which are employed as component (D) can be illustrated by the formula $$R_6-O-(CH_2-CH_2-O)_{n_1}-(\underset{Z_1}{CH}-\underset{Z_2}{CH}-O)_z-CH_2CH_2O)_{n_2}-H \quad (6)$$

wherein $R_6$ is hydrogen, alkyl or alkenyl each containing at most 18 carbon atoms, preferably 4 to 18 carbon atoms, o-phenylphenyl or alkylphenyl containing 4 to 12 carbon atoms in the alkyl moiety, one of $Z_1$ and $Z_2$ is hydrogen and the other is methyl, z is 1 to 15 and the sum of $n_1+n_2$ is 5 to 10.

Further non-ionic surfactants which can be successfully employed as component (D) are reaction products of the following compounds:

(i) 1 mole of an adduct of 2 to 15, preferably 3 to 8, moles of propylene oxide with 1 mole of an at least trivalent aliphatic alcohol containing 3 to 6 carbon atoms, preferably pentaerythritol, (ii) 3 to 6 moles of acrylamide, and (iii) 3 to 6 moles of formaldehyde or of a formaldehyde donor, e.g. paraformaldehyde or trioxane.

Preferred solvents of component (E) are those which boil above 160° C. Suitable solvents which can be employed as component (E) are e.g. alkylene glycols, for example ethylene glycol or propylene glycol; phenoxyethanol; dialkylene glycol monoalkyl ethers, e.g. diethylene glycol monomethyl, monoethyl, monobutyl and monohexyl ether; acetates, such as phenyl acetate and benzyl acetate; benzyl alcohol, furfuryl alcohol, diacetone alcohol and tributylphosphate, dibutyl phthalate, dioctyl phthalate and polyhalogenated paraffin or aliphatic hydrocarbon oils, such as paraffin oil. Preferred components (E) are benzyl alcohol, ethylene glycol and phenoxyethanol.

Depending on their solids content, components (C), (D) and (E) are added to the dye liquors, alone or as mixtures, in amounts varying from 2.5 to 25 g/l.

Components (A) and (C), (D) and/or (E) can also be added to the padding liquor in the form of an anhydrous or preferably aqueous preparation, in which connection the weight ratio of component (A) to components (C), (D) and/or (E) advantageously varies from 5:1 to 1:5, preferably from 2:1 to 1:2.

The preparations can be obtained by simple stirring the above components (A) and (C), (D) and/or (E). By addition of water and optionally a base, e.g. an alkali metal hydroxide, such as sodium or potassium hydroxide, or a lower alkanolamine, such as monoethanolamine, diethanolamine or, in particular, triethanolamine, they are obtained in the form of homogeneous, preferably clear, mixtures, which have a very good shelf life at room temperature.

The novel preparations can also be obtained without water. The preparations advantageously contain, in each case based on the weight of the preparation, 10 to 50% by weight of component (A)

10 to 50% by weight of components (C), (D) and (E), alone or as mixtures of two or three components, 20 to 80% by weight of water and 0 to 5% by weight of a base.

Suitable substantive dyes are the conventional anionic direct dyes, for example the "Direct Dyes" listed on pages 2005–2478 in the Colour Index, 3rd Edition (1971), Vol. 2. The amount of dye depends as a rule on the desired colour strength and is advantageously 1 to 100 g/l, preferably 20 to 100 g/l and, most preferably, 20 to 50 g/l.

The padding liquor can additionally contain further ingredients, for example wetting agents, antifoams, and thickeners, e.g. alginates, polyacrylates, starch ethers, flour derivatives, and salts, e.g. sodium chloride. The pH value of the liquor is ordinarily from 5 to 8.

Suitable cellulose material is that made of natural or regenerated cellulose, for example hemp, jute, viscose rayon, viscose staple fibre, and, in particular, cotton, and also fibre blends, for example polyester/acrylonitrile, polyester/viscose and, in particular polyester/cotton blends, the polyester component of which is dyes with disperse dyes beforehand, simultaneously or subsequently. The cellulose fibrous material can be in the most diverse states of processing, for example as loose material, yarn, wovens or knits.

The aqueous liquors can be applied in known manner to the fibrous material, advantageously by impregnating the material on a padder. The liquor-pick is about 50 to 100% by weight. Suitable padding methods are the pad-thermofix process or the pad-steam process.

The padding can be effected at 20° to 60° C., but preferably at room temperature. After it has been padded and squeezed out, the cellulose material, if desired after an intermediate drying, is subjected to a heat treatment e.g. in the temperature ranges from 100° to 210° C. Preferably the heat treatment is carried out by thermofixation at a temperature from 120° to 210° C., preferably at 140° to 180° C., after an intermediate drying at 80° to 120° C. The heat treatment can also be carried out direct, i.e. without an intermediate drying, by steaming at 100° to 120° C. Depending on the nature of the heat development and the temperature range, the heat treatment can take from 30 seconds to 10 minutes. If desired, the padded and squeezed cellulose material can also be rolled up before being dried and subjected to the heat treatment, packed in a plastic sheet and stored for 4 to 24 hours at room temperature.

Immediately after the heat treatment, the dyed cellulose material can be given a washing-off in conventional manner in order to remove non-fixed dye or melamine derivative. To this end, the substrate is treated e.g. at 40° to 80° C. in a solution which contains soap or synthetic detergent. In most cases it is not necessary to give the dyed goods an afterwash.

Level dyeings of good wet- and lightfastness properties are obtained by the process of the present invention. In particular, owing to the synergistic action of components (A) and (C) or (D) or (E) it is possible to obtain an increase in the dye yield of 100 to 400%, without the addition of urea, in the continuous dyeing process, especially in a pad-thermofix process.

The invention is illustrated in more detail by the following Examples, in which the percentages are by weight, unless otherwise stated. The amounts of dye refer to commercially available, i.e. diluted, goods, and the amounts of components (A) to (E) refer to pure substance. The five-figure Colour Index (C.I.) refer to the 3rd Edition of the Colour Index.

The following reaction products are examples of components (C) and (D):

$C_1$: the ammonium salt of the acid sulfuric acid ester of the adduct of 1 mole of ethylene oxide and 1 mole of alfol (1014);

$C_2$: the ammonium salt of the acid sulfuric acid ester of the adduct of 1 mole of ethylene oxide and 1 mole of stearyl alcohol;

$C_3$: the ammonium salt of the acid sulfuric acid ester of the adduct of 1 mole of ethylene oxide and 1 mole of 2-ethylhexanol;

$C_4$: the ammonium salt of the acid sulfuric acid ester of the adduct of 35 moles of ethylene oxide and 1 mole of stearyl alcohol;

$C_5$: the ammonium salt of the acid sulfuric acid ester of the adduct of 3 moles of ethylene oxide and 1 mole of tridecyl alcohol;

$C_6$: the ammonium salt of the acid sulfuric acid ester of the adduct of 4 moles of ethylene oxide and 1 mole of hydroabietyl alcohol;

$C_7$: the ammonium salt of the acid sulfuric acid ester of the adduct of 3 moles of ethylene oxide and 1 mole of alfol (2022);

$C_8$: the ammonium salt of the acid sulfuric acid ester of the adduct of 3 moles of ethylene oxide and 1 mole of lauryl alcohol;

$C_9$: the acid phosphoric acid ester of the adduct of 10 moles of ethylene oxide and 1 mole of p-nonylphenol;

$C_{10}$: the ammonium salt of the acid sulfuric acid ester of the adduct of 3 moles of ethylene oxide and 1 mole of butylphenol;

$C_{11}$: the ammonium salt of the acid sulfuric acid ester of the adduct of 5 moles of ethylene oxide and 1 mole of tributylphenol;

$C_{12}$: the ammonium salt of the acid sulfuric acid ester of the adduct of 2 moles of ethylene oxide and 1 mole of nonylphenol;

$C_{13}$: the ammonium salt of the acid sulphuric acid ester of the adduct of 2 moles of propylene oxide and 1 mole of ethylene oxide and 1 mole of nonylphenol;

$C_{14}$: The ammonium salt of the acid sulfuric acid ester of the adduct of 35 moles of ethylene oxide and 1 mole of nonylphenol;

$C_{15}$: The ammonium salt of the acid sulphuric acid ester of the adduct of 50 moles of ethylene oxide and 1 mole of nonylphenol;

$C_{16}$: the ammonium salt of the acid sulfuric acid ester of the adduct of 15 moles of propylene oxide and 1 mole of nonylphenol;

$C_{17}$: the ammonium salt of the acid sulfuric acid ester of the adduct of 6 moles of ethylene oxide and 1 mole of dodecylphenol;

$C_{18}$: the ammonium salt of the acid sulfuric acid ester of the adduct of 6 moles of ethylene oxide and 1 mole of pentadecylphenol;

$C_{19}$: the ammonium salt of the acid sulfuric acid ester of the adduct of 8 moles of ethylene oxide and 1 mole of o-phenylphenol;

$C_{20}$: the ammonium salt of the acid sulfuric acid ester of the adduct of 60 moles of propylene oxide and glycerol;

$C_{21}$: the ammonium salt of the acid sulfuric acid ester of the adduct of 2 moles of ethylene oxide and 1 mole of coconut fatty acid;

$C_{22}$: the ammonium salt of the acid sulfuric acid ester of the adduct of 2 moles of propylene oxide and 1 mole of of coconut fatty acid;

$C_{23}$: the ammonium salt of the acid sulfuric acid ester of the adduct of 15 moles of ethylene oxide and 1 mole of stearic acid $\beta$-hydroxyethylamide;

$C_{24}$: the ammonium salt of the acid sulfuric acid ester of the adduct of 2.5 moles of ethylene oxide and 1 mole of tallow fatty amine;

$C_{25}$: the ammonium salt of the acid disulfuric acid ester of polybutylene glycol having an average molecular weight of 2,000;

$C_{26}$: the sodium salt of the acid maleic acid ester of the adduct of 2 moles of ethylene oxide and 1 mole of p-nonylphenol;

$C_{27}$: the sodium salt of the acid monosulfosuccinic acid ester of the adduct of 2 moles of ethylene oxide and 1 mole of p-nonylphenol;

$C_{28}$: the sodium salt of the acid dimaleic acid ester of polypropylene glycol having an average molecular weight of 1,000;

$C_{29}$: the ammonium salt of the acid phosphoric acid ester of the adduct of 2 moles of ethylene oxide and 1 mole of nonylphenol;

$C_{30}$: the ammonium salt of the acid phosphoric acid ester of the adduct of 10 moles of ethylene oxide and 1 mole of p-nonylphenol;

$C_{31}$: the sodium salt of the acetate of the adduct of 4 moles of ethylene oxide and 1 mole of octylphenol;

$C_{32}$: the di-($\beta$-hydroxyethyl)amine salt of the acid sulfuric acid ester of the adduct of 3 moles of ethylene oxide and 1 mole of lauryl alcohol;

$C_{33}$: the sodium salt of the acid sulfuric acid ester of the adduct of 2 moles of ethylene oxide and 1 mole of lauryl alcohol;

$C_{34}$: the sodium salt of the acid sulfuric acid ester of the adduct of 3 moles of ethylene oxide and 1 mole of lauryl alcohol;

$C_{35}$: the ammonium salt of the acid sulfuric acid ester of the adduct of 8 moles of ethylene oxide and 1 mole of tallow fatty amine;

$C_{36}$: the ammonium salt of the acid sulfuric acid ester of the adduct of 2, 4 or 6 moles of ethylene oxide and 1 mole of tallow fatty amine;

$C_{37}$: the ammonium salt of the acid sulfuric acid ester of the adduct of 3 moles of propylene oxide and 5 moles of ethylene oxide and 1 mol of tallow fatty amine;

$C_{38}$: the ammonium salt of the acid sulfuric acid ester of the adduct of 1 mol of styrene oxide and 8 moles of ethylene oxide and 1 mol of dodecylamine;

$C_{39}$: the sodium salt of the acid sulfosuccinic acid hemiester of the adduct of 8 moles of ethylene oxide and 1 mole of tallow fatty amine; and $C_{40}$: the ammonium salt of the acid phosphoric acid ester of the adduct of 8 moles of ethylene oxide and 1 mole of tallow fatty amine;

$C_{41}$: the acid phosphoric acid ester of the adduct of 5 moles of ethylene oxide and 1 mole of 2-ethyl-n-hexanol.

Component (D)

$D_1$: the reaction product of 3 moles of ethylene oxide and 1 mol of 2-ethyl-hexanol;

$D_2$: the reaction product of 5 moles of ethylene oxide and 1 mole of 2-ethylhexanol;

$D_3$: the reaction product of 3 moles of ethylene oxide and 1 mole of stearyl alcohol;

$D_4$: the reaction product of 9 moles of ethylene oxide and 1 mole of alfol (1014);

$D_5$: the reaction product of 3 moles of ethylene oxide and 1 mole of hexadecyl alcohol;

$D_6$: the reaction product of 15 moles of ethylene oxide and 1 mole of oleyl alcohol;

$D_7$: the reaction product of 1 mole of ethylene oxide and 1 mole of phenol;

$D_8$: the reaction product of 4 moles of ethylene oxide and 1 mole of p-cresol;

$D_9$: the reaction product of 5 moles of ethylene oxide and 1 mole of tributylphenol;

$D_{10}$: the reaction product of 4 moles of ethylene oxide and 1 mole of octylphenol;

$D_{11}$: the reaction product of 9 moles of ethylene oxide and 1 mole of nonylphenol;

$D_{12}$: the reaction product of 4 moles of ethylene oxide and 1 mole of nonylphenol;

$D_{13}$: the reaction product of 6 moles of ethylene oxide and 1 mole of nonylphenol;

$D_{14}$: the reaction product of 8 moles of ethylene oxide and 1 mole of o-phenylphenol;

$D_{15}$: the reaction product of 5 moles of ethylene oxide and 1 mole castor oil;

$D_{16}$: the reaction product of 51 moles of propylene oxide and 5 moles of ethylene oxide and 1 mole of glycerol;

$D_{17}$: the reaction product of 51 moles of propylene oxide and 12 moles of ethylene oxide and 1 mole of glycerol;

$D_{18}$: the reaction product of 3 moles of ethylene oxide and 1 mole of oleic acid;

$D_{19}$: the reaction product of 2 moles of polypropylene glycol (molecular weight 1000) and 1 mole of adipic acid;

$D_{20}$: the reaction product of 12 moles of ethylene oxide and 12 moles of propylene oxide and 1 mole of stearyl alcohol;

$D_{21}$: the reaction product of 80 moles of ethylene oxide and 1 mole of oleyl alcohol;

$D_{22}$: the tetramethylol compound of the reaction product of 4 moles of acrylamide with the adduct of 8 moles of propylene oxide and 1 mole of pentaerythritol.

EXAMPLE 1

Cotton corduroy is padded with an aqueous dye liquor which contains 20 g/l of a dye of the formula

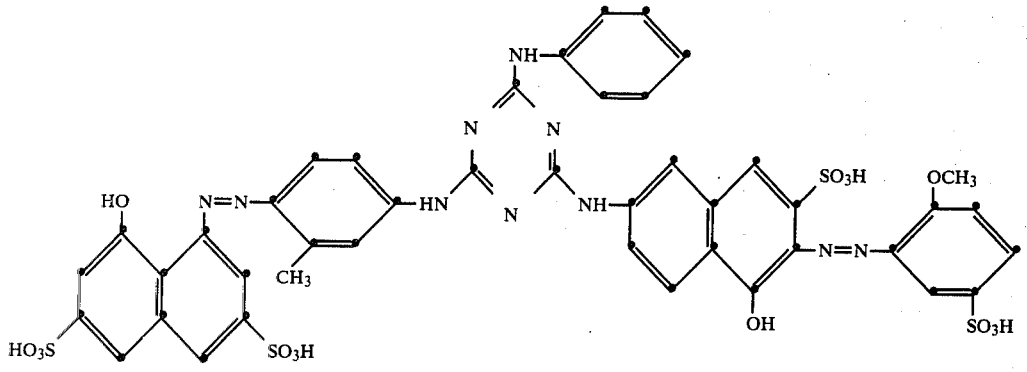

(101)

60 g/l of a preparation (1) consisting of 12% of the anionic surfactant $C_{12}$, 20% of hexamethylolmelamine-hexamethyl ether, 3% of triethanolamine and 65% of water, and 2 g/l of hydroxylamine sulfate and 918 g/l of water. The goods are squeezed out to a pick-up of 85%. The cotton fabric is then dried at 80° C. and subjected to a thermosol treatment for 4 minutes at 160° C. After rinsing the goods in cold water, a level red dyeing is obtained. If the same procedure is repeated, but without the addition of preparation (1), the dyeing is 50% lighter in shade.

Strong, level dyeings are also obtained by substituting for the dye of formula (101) the same amount of a dye of the formula

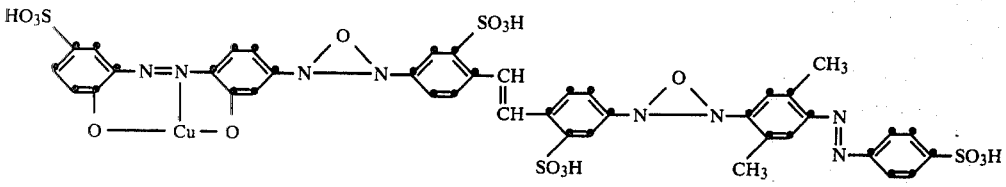

(102)

or the same amount of a direct dye (Direct Blue 106 C.I. 51300). However, if dyeing is carried out without preparation (1), then the resultant dyeings are, respectively, 40% and 70% weaker.

Strong and level dyeings are also obtained by using, instead of preparation (1), the same amount of the following preparations (2) to (7):

(2) preparation consisting of:

12% of the anionic surfactant $C_{12}$,

20% of hexamethylolmelamine-hexamethyl ether,

4% of phenoxyethanol,

2% of ethanolamine and

62% of water;

(3) preparation consisting of:

30% of the non-ionic surfactant $D_{15}$,

20% of hexamethylolmelamine-hexamethyl ether and

50% of water;

(4) preparation consisting of:

20% of ethylene glycol,

25% of hexamethylolmelamine-hexamethyl ether and

55% of water;

(5) preparation consisting of:

25% of hexamethylolmelamine-hexamethyl ether,

25% of the non-ionic surfactant $D_{22}$,

50% of water;

(6) preparation consisting of:

20% of the anionic surfactant $C_{12}$,

25% of hexamethylolmelamine-hexamethyl ether,

12% of the non-ionic surfactant $D_{14}$ and

43% of water; and (7)

15% of a mixture consisting of the anionic surfactant $C_{32}$ and coconut fatty acid N,N-bis-(2-hydroxyethyl)-amide (1:1), 25% of hexamethylolmelamine-hexamethyl ether and 60% of water.

EXAMPLE 2

A viscose/staple fibre fabric is padded with an aqueous dye liquor which contains 15 g/l of a copper phthalocyanine dye of the formula $$CuPc—(SO_2NH—Na)_3 \quad (103)$$

40 g/l of a preparation consisting of 20% of the anionic surfactant $C_9$, 20% of hexamethylolmelamine-hexamethyl ether, 3% of triethanolamine and 57% of water, 2 g/l of ammonium acetate and 1.5 g/l of locust bean gum. The fabric is squeezed out to a pick-up of 75%. The fabric is then treated for 4 minutes at 160° C. After excess dye has been washed off in cold water, the fabric is given an after-treatment for 15 minutes at room temperature with an aqueous solution which contains, based on the weight of the fabric, 2% of a condensation product of ethylenediamine dihydrochloride, formaldehyde and boric acid. After the fabric has been dried, an intense turquoise blue dyeing is obtained.

If the same procedure is repeated, but without addition of the preparation (8), the dyeing is 70% lighter in shade.

EXAMPLE 3

Viscose/rayon lining is padded with a dye liquor which contains 30 g/l of a dye of the formula (104)

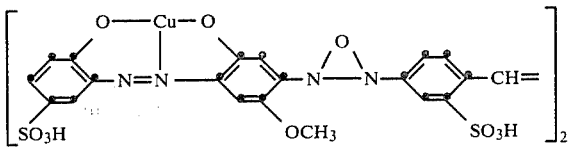

50 g/l of a preparation (9) consisting of 30% of the non-ionic surfactant $D_{21}$, 20% of hexamethylolmelaminehexamethyl ether and 50% of water, and 3 g/l of the ammonium salt of maleic acid. The goods are squeezed out to a pick-up of 83%.

After it has been padded, the fabric is rolled up, packed in a polyethylene sheet and stored for 18 hours at room temperature while being slowly rotated continuously. The fabric is then dried on a tenter frame at 90° C. and subsequently subjected to a dry heat treatment for 5 minutes at 150° C. The fabric is then rinsed with cold water and given an after-treatment with an aqueous solution which contains, based on the weight of the fabric, 3% of a dicyandiamide-ureaformaldehyde condensation product. A fast, dark grey dyeing is obtained. If the same procedure is repeated, but without addition of the preparation (9), the resultant dyeing is 60% lighter in shade.

EXAMPLE 4

A polyester/cotton blend (66% polyester, 34% cotton) is padded with a dye liquor which contains 20 g/l of a dye of the formula (105)

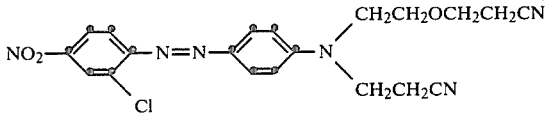

5 g/l of silicone-containing anionic surfactant, e.g. a sulfated nonylphenol-polyglycol ether, 20 g/l of a polyacrylate thickener, 2 g/l of ammonium acetate, 60 g/l of a preparation (10) consisting of 20% of benzyl alcohol, 25% of hexamethylolmelamine-hexamethyl ether and 55% of water.

The goods are squeezed out to a pick-up of 90%. The padded goods are then dried at 95° C. and subjected to a thermosol treatment for 40 seconds at 200° C. The fabric is then rinsed cold and given an aftertreatment with an aqueous solution of the condensation product of dicyandiamide, formaldehyde and urea. A level, red dyeing is obtained and both fibre components have the same shade.

EXAMPLE 5

Cotton fabric is padded with a dye liquor which contains 20 g/l of a direct dye (Direct Red 23 C.I. 29160), 50 g/l of a preparation (11) consisting of 20% of the anionic surfactant $C_{41}$, 20% of hexamethylolmelamine-hexamethyl ether, 3% of triethanolamine and 57% of water, and 2 g/l of ammonium acetate.

The cotton is squeezed out to a pick-up of 70%. After it has been padded, the fabric is dried and subjected to a dry heat treatment for 90 seconds at 170° C. Instead of being dried and thermofixed, the cotton fabric can also be steamed for 10 minutes at 120° C. with saturated steam. After the heat treatment, the goods are rinsed in cold water. An intense, level red dyeing is obtained.

By repeating the above procedure, but without addition of preparation (11), a dyeing which is 80% lighter in shade is obtained.

What is claimed is:

1. A process for slop-padding textile cellulose material with an anionic substantive dye, which comprises applying to said material an aqueous liquor which, in addition to the dye, contains (A) 2.5 to 15 g/l of an etherified N-methylolmelamine, (B) an acid catalyst and at least one of the components (C) an anionic surfactant, (D) a non-ionic surfactant and (E) an organic solvent which boils above 140° C., and subsequently subjecting the material to a heat treatment.

2. A process according to claim 1, wherein the aqueous dye liquor contains 20 to 100 g/l of anionic substantive dye.

3. A process according to claim 1, wherein the aqueous dye liquor contains, as component (A), a N-methylolmelamine which is etherified with methanol or ethanol.

4. A process according to claim 3, wherein component (A) is hexamethylolmelamine-hexamethyl ether.

5. A process according to claim 1, wherein component (B) is an ammonium salt of an inorganic acid or $C_1$-$C_5$-carboxylic acid.

6. A process according to claim 1, wherein component (C) is an anionic surfactant of the formula $$Q-\left[(\underset{Y_1}{CH}-\underset{Y_2}{CH}-O)_m-X\right]_q \quad (1)$$

wherein

Q is $R_1$—O—, $R_2(O)_t$, $R_3$—CO—O— or $R_4$—N<, $R_1$ is a monovalent aliphatic hydrocarbon radical of 8 to 22 carbon atoms, a cycloaliphatic hydrocarbon radical of 10 to 22 carbon atoms, o-phenylphenyl or alkylphenyl containing 4 to 16 carbon atoms in the alkyl moiety, $R_2$ is an aliphatic hydrocarbon radical of 2 to 6 carbon atoms, $R_3$ is an aliphatic hydrocarbon radical of 7 to 21 carbon atoms, $R_4$ is an aliphatic hydrocarbon radical of 12 to 22 carbon atoms, one of $Y_1$ and $Y_2$ is hydrogen, methyl or phenyl and the other is hydrogen, X is the acid radical of an inorganic oxygen-containing acid or of a dicarboxylic acid or is the radical —$CH_2COOH$, m, t and g are integers, m is 1 to 30, t is 2 to 6 and q is 1 or, if Q is $R_2(O)_t$, q is 2 to 6, or, if Q is $R_4$—N<, q is 2, with the proviso that the substituents of $R_2$ or the two substituents at the nitrogen atom are the same or different.

7. A process according to claim 6, wherein component (C) is an anionic surfactant of the formula $$R_1-O-(\underset{Y_1}{CH}-\underset{Y_2}{CH}-O)_m-X \quad (2)$$

$$R_3-CO-O-(\underset{Y_1}{CH}-\underset{Y_2}{CH}-O)_m-X \text{ or} \quad (3)$$

$$R_4-N\begin{cases}(\underset{Y_1}{CH}-\underset{Y_2}{CH}-O)_r-X\\(\underset{Y_1}{CH}-\underset{Y_2}{CH}-O)_s-X\end{cases} \quad (4)$$

wherein $R_1$, $R_3$, $R_4$, $Y_1$, $Y_2$, X and m are as defined in claim 6 and r and s are integers, the sum of which is 2 to 15.

8. A process according to claim 7, wherein component (C) is an anionic surfactant of the formula (2), wherein $R_1$ is alkylphenyl containing 4 to 12 carbon atoms in the alkyl moiety, o-phenylphenyl or alkyl or alkenyl, each of 8 to 18 carbon atoms, and m is 2 to 15.

9. A process according to claim 8, wherein component (C) is an anionic surfactant of the formula

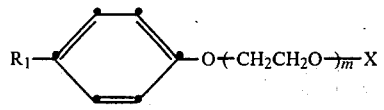

(5)

wherein $R_1$ is octyl or nonyl, m is 2 to 10, X is derived from sulfuric acid or orthophosphoric acid, and the surfactant is in the form of the free acid or sodium or ammonium salt.

10. A process according to claim 7, wherein component (C) is an anionic surfactant of the formula (4), wherein $R_4$ is alkenyl or alkyl, each of 16 to 22 carbon atoms, each of $Y_1$ and $Y_2$ is hydrogen, the sum of r and s is 2 to 10, X is —$SO_3M$ and M is sodium or —$NH_4$.

11. A process according to claim 1 wherein component (D) is a non-ionic alkylene oxide adduct of 1 to 100 moles of alkylene oxide with 1 mole of an aliphatic monoalcohol containing at least 4 carbon atoms, of a trivalent to hexavalent aliphatic alcohol having from 3 to 6 carbon atoms, of a phenol which is unsubstituted or substituted by alkyl or phenyl or of a fatty acid which contains 8 to 22 carbon atoms.

12. A process according to claim 1, wherein component (D) is a non-ionic surfactant of the formula $$R_6-O-(CH_2-CH_2-O)_{n_1}-(\underset{Z_1}{CH}-\underset{Z_2}{CH}-O)_z-(CH_2CH_2O)_{n_2}-H \quad (6)$$

wherein $R_6$ is hydrogen, alkyl or alkenyl each containing at most 18 carbon atoms, o-phenylphenyl or alkylphenyl containing 4 to 12 carbon atoms in the alkyl moiety, one of $Z_1$ and $Z_2$ is hydrogen and the other is methyl, z is 1 to 15 and the sum of $n_1$ and $n_2$ is 5 to 100.

13. A process according to claim 1, wherein component (D) is a reaction product of (i) 1 mole of an adduct of 2 to 15 moles of propylene oxide with 1 mole of an at least trivalent aliphatic alcohol containing 3 to 6 carbon atoms, (ii) 3 to 6 moles of acrylamide and (iii) 3 to 6 moles of formaldehyde or a formaldehyde donor.

14. A process according to claim 1, wherein component (E) is benzyl alcohol, ethylene glycol or phenoxyethanol.

15. A process according to claim 1, wherein the aqueous dye liquor contains 2.5 to 25 g/l of component (C), (D) or (E) or a mixture thereof.

16. A process according to claim 1, which comprises the use of a preparation which contains component (A) and at least one of components (C), (D) and (E).

17. A process according to claim 16, wherein the preparation additionally contains water.

18. A process according to claim 16, wherein the preparation additionally contains a base.

19. A process according to claim 17, wherein the aqueous preparation contains 10 to 50% by weight of component (A), 10 to 50% by weight of component (C), (D) or (E) or a mixture of two or three of these components, 20 to 80% by weight of water and 0 to 5% by weight of a base, the amounts being based on the weight of the entire preparation.

20. A process according to claim 1, wherein the cellulose material is employed in the form of a blend with synthetic fibres.

21. A process according to claim 20, wherein the blend is of polyester/cotton, polyester/viscose or polyacrylonitrile/cotton.

22. A process according to claim 1, wherein dyeing is carried out by a pad-thermofix process.

23. A process according to claim 22, wherein the thermofixation is carried out at a temperature of 120° to 210° C.

24. A process according to claim 1, which comprises
(1) applying to said material an aqueous liquor which, in addition to the dye, contains
(A) 2.5 to 15 g/l of an etherified N-methylolmelamine,
(B) an acid catalyst and at least one of the components
(C) an anionic surfactant,
(D) a non-ionic surfactant and
(E) an organic solvent which boils above 140° C.,
(2) drying said material, and subsequently
(3) subjecting the material to a thermofixation.

25. A process according to claim 24, wherein the intermediate drying (2) is carried out at a temperature of 80° to 120° C.

26. An aqueous dye liquor for padding textile cellulose material which comprises at least one anionic substantive dye, a preparation containing
(A) 2.5 to 15 g per liter dye liquor of an etherified N-methylolmelamine and at least one of the components
(C) an anionic surfactant,
(D) a non-ionic surfactant and
(E) an organic solvent which boils above 140° C.,
and an acid catalyst.

* * * * *